US006012220A

United States Patent [19]

Cornejo

[11] Patent Number: 6,012,220

[45] Date of Patent: Jan. 11, 2000

[54] SELF STORING EXPANDER BACK PLATES

[75] Inventor: Antonio P. Cornejo, Tyler, Tex.

[73] Assignee: Carrier Corporation, Farmington, Conn.

[21] Appl. No.: 09/119,991

[22] Filed: Jul. 21, 1998

[51] Int. Cl.[7] ..... B23P 15/26

[52] U.S. Cl. ..... 29/727; 29/33 G

[58] Field of Search ..... 29/726, 727, 890.047, 29/33 G

[56] References Cited

U.S. PATENT DOCUMENTS

| | | | |
|---|---|---|---|
| 4,646,548 | 3/1987 | Zimmerli et al. . | |
| 5,003,691 | 4/1991 | Milliman et al. | 29/727 |
| 5,220,722 | 6/1993 | Milliman | 29/727 |
| 5,353,496 | 10/1994 | Harman et al. | 29/727 |
| 5,680,695 | 10/1997 | Vetter | 29/727 |
| 5,685,066 | 11/1997 | Mohrmann et al. | 29/727 |
| 5,687,473 | 11/1997 | Tokura | 29/727 |

*Primary Examiner*—Irene Cuda
*Attorney, Agent, or Firm*—Wall Marjama Bilinski & Burr

[57] ABSTRACT

A fixture for supporting a heat exchanger coil within a tube expander apparatus. The back wall of the fixture contains a series of spaced apart vertically disposed stationary slats. A moveable frame is slidably mounted in the back wall which contains a series of vertically disposed spaced apart moveable slats that are interspaced between the stationary slats. The slats coact to present an adjustable flat support surface to a coil mounted in the fixture that can be adjusted to accommodate different size coils. The front door of the fixture contains a similarly adjustably wall that coacts with the back wall to fully support a coil in the fixture as the tubes of the coil are being expanded.

7 Claims, 3 Drawing Sheets

SELF STORING EXPANDER BACK PLATES

BACKGROUND OF THE INVENTION

This invention relates to a fixture for expanding the tubes of a heat exchanger coil into holding contact with the tube sheets and heat exchanger fins of the coil and, in particular, to a tube expanding fixture that can accommodate heat exchanger coils of varying sizes with a minimum of change over adjustments.

As explained in detail in U.S. Pat. No. 4,646,548, during the production of a heat exchanger coil of the type typically employed in air conditioning units, thin heat exchanger fins are stacked between a pair of heavier tube sheets and hairpin tubes are passed through holes provided in the stack. A hairpin tube, as the name implies, is one that is bent at its midsection to provide two parallel legs of substantially equal length. The legs of the hairpins are passed through the coil stack and the hair pins are cojoined by tube bends to establish a refrigerant flow channel that passes back and forth through the coil. The coil can act either as a condenser or an evaporator in a refrigeration system.

During production of the coils, the hairpins are inserted into the coil stack and the assembly is then placed in a tube expander fixture. The expander fixture has a front door that opens so that a coil can be received within the fixture. A saddle is located in the lower part of the fixture that contains seats upon which the bends of the hairpins rest. The tubes are supported vertically in the housing with their open ends aligned beneath an array of expander rods which are sometimes referred to as "bullets". When the coil is properly mounted in the fixture, the door is closed and secured and the rods are passed downwardly into the tubes to expand the tubes into locking contact with the tube sheets and the fins.

The coil assembly must be properly supported during the expansion process to prevent the tubes from buckling or the assembly from otherwise being damaged. Heretofore, the fixture could handle heat exchangers up to a certain size, after which the back wall of the fixture had to be removed and replaced with a larger panel. This change over procedure was both time consuming and labor intensive, thus necessitating the use of a good deal of equipment and extensive down time. In addition, the back panel of the fixture typically is relatively a heavy piece and if improperly handled, can be dislodged causing damage to the equipment and potential harm to those attempting to replace the panels.

It has also been customary to increase the size of the housing door corresponding to an increase in the size of the back wall panel. This has been achieved by securing additional horizontal bar to the door so that the height of the door is substantially equal to that of the back panel. The addition of bars to the door, although easier and less time consuming to accomplish the replacement of the back panel, again take time and effort further increasing the expense of a change over.

SUMMARY OF THE INVENTION

It is, therefore, an object of the present invention to improve fixtures for expanding the tubes of a heat exchanger coil and particularly, fin coils used in air conditioning systems.

It is a further object of the present invention to provide a tube expander that can handle a wide range of different size coils without having to replace the back panel of the expander fixture.

Another object of the invention is to permit a tube expander to process different size coils without having to remove the back panel of the expander housing.

Yet another object of the present invention is to reduce the amount of time required to change over a tube expander from processing one size coil to processing a second different size coil.

Still another object of the present invention is to provide for the safety of those working with tube expanding equipment.

These and other objects of the present invention are attained by a tube expander for supporting various size coils within a fixture during the expansion of tubes into contact with the tube sheets and heat exchanger fins. The back wall of the housing contains a series of spaced apart vertically disposed stationary slats. A moveable frame is slidably mounted in the back wall which contains a series of spaced apart vertically disposed moveable slats that are interspaced between the openings between the stationary slats. The slats coact to present a flat surface to a coil mounted within the fixture which helps to support the coil assembly as the tubes are being expanded. In a further embodiment of the invention, the door of the fixture also contains a similar assembly having one set of stationary slats and one set of interlaced slats whereby the vertical height of the door can also be further adjusted to accommodate various size coils.

BRIEF DESCRIPTION OF THE DRAWINGS

For a better understanding of these and other objects of the present invention, reference will be made to the following detailed description of the invention which is to be read in association with the accompanying drawings wherein.

DESCRIPTION OF THE INVENTION

Figure 1:
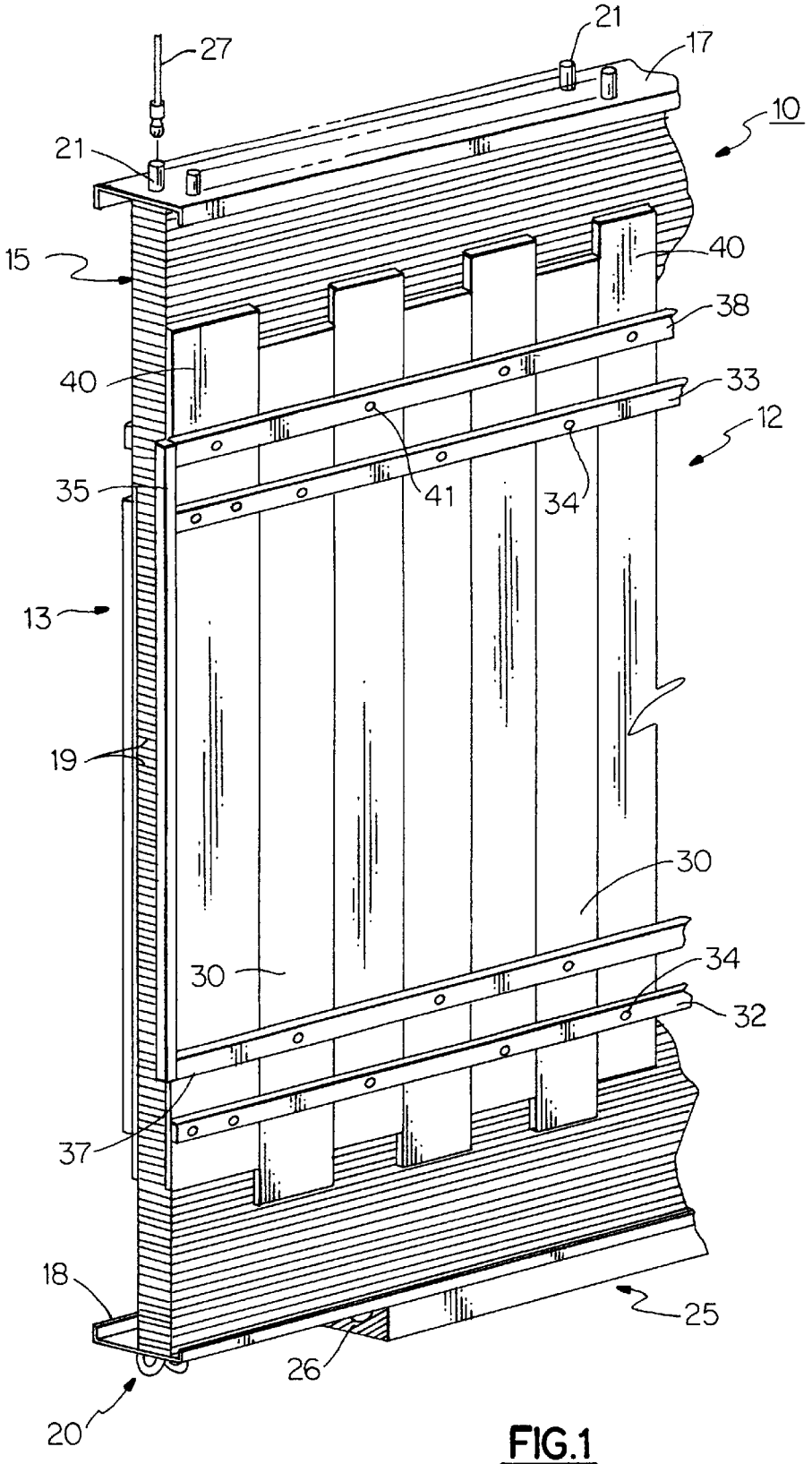
FIG. 1 is a rear perspective view of illustrating a coil supporting fixture embodying the teachings of the present invention.
Figure 2:
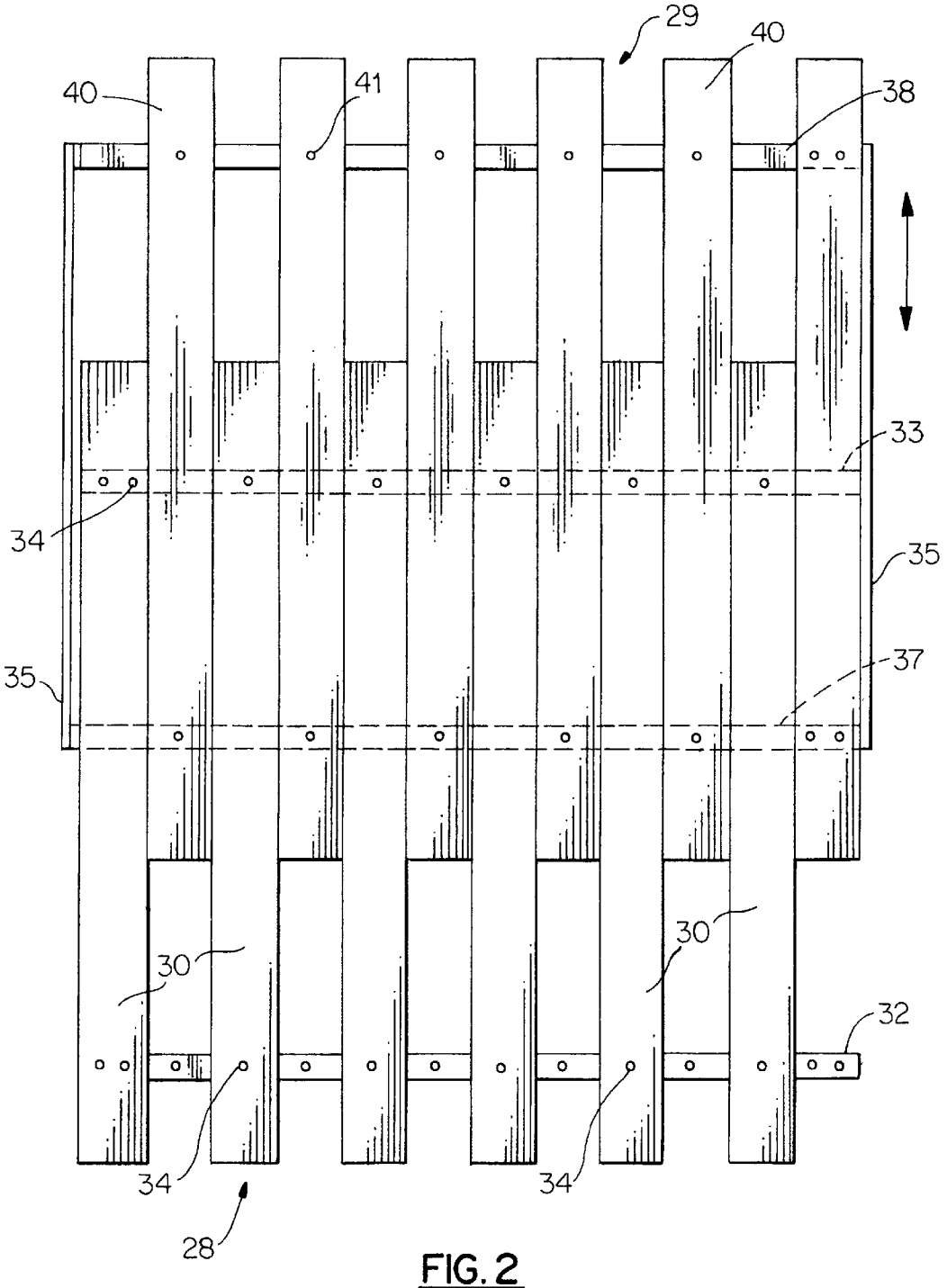
FIG. 2 is a front view showing the adjustable rear wall of the apparatus of the present invention.

Turning initially to FIGS. 1 and 2, there is shown a tube expander fixture, generally referenced 10, with some components omitted for the sake of clarity. The fixture includes a vertically disposed adjustable back wall 12, and a front door 13 which, as will be explained in greater detail below, is hinged to the main frame of the fixture through which a heat exchanger coil 15 can be loaded into the fixture. As noted above, the coil includes a pair of opposed spaced apart tube sheets 17 and 18 between which a series of heat exchanger fins 19 are stacked. A series of U-shaped hair pin tubes 20 are passed through aligned holes in the coil stack with the open ends 21 of the tubes extending outwardly beyond tube sheet 17. A contoured saddle 25 is mounted in the bottom of the fixture that has a plurality of seats 26 in which the bend sections of the hairpins rest when the coil is loaded into the fixture. The saddle coacts with the back wall to support the coil so that the tubes are vertically disposed in the fixture. Closing and securing the fixture door further supports the coil in this position with the coil clearance between the back door and the back wall being about 0.004".

An array of tube expander rods 27 similar to those described in the previously noted U.S. Pat. No. 4,646,548 are arranged above the open ends of the hairpin tubes in axial alignment therewith. The rods are arranged to move downwardly through the open ends of the tubes to a sufficient depth such that the tubes are expanded radially to lock the tubes within the tube sheets and the heat exchanger fins, thereby closing the assembly.

The fixture typically will be called upon to process coils of different sizes having tubes of various lengths. The adjustable back wall of the present fixture is capable of being expanded vertically to securely support coils of different sizes. The back wall, as best illustrated in FIG. 2, contains two interrelated sections that includes a stationary lower section 28 and a moveable upper section 29 that can be raised and lowered in a vertical direction. The lower section of the wall contains a series of vertically disposed spaced apart flat stationary slats 30—30. The slats are secured to a pair of parallelly aligned horizontal cross members 32 and 33. The cross members extend behind the stationary slats and are secured to the slats using screws 34 or the like. The cross members, in turn, are secured at their extreme ends to the fixture support structure (not shown) using threaded fasteners to securely mount the stationary slats in the fixture. The slats are uniformly spaced across the back of the fixture and present a flat surface to a coil mounted in the fixture.

The moveable upper section of the back wall includes a frame 35 to which a second pair of horizontal cross members 37 and 38 are secured. A series of spaced apart stationary slats 40—40 are secured to the front of the cross members 37 and 38 by screws 41. The width of the space between the moveable slats is substantially equal to the width of the stationary slats and the moveable slats are slidably contained between the stationary slats. In assembly, the cross members 37 and 38 are located on either side of the stationary cross member 32 so that the moveable slats are slidably retained within the lower section of the wall. As can be seen, the upper section of the back wall can be raised or lowered between the limits allowed by the horizontal members to increase and decrease the effective height of the wall.

Accordingly, different size coils can be easily accommodate within the fixtures that are within the adjustable range of the back wall of the fixture.

Figure 3:
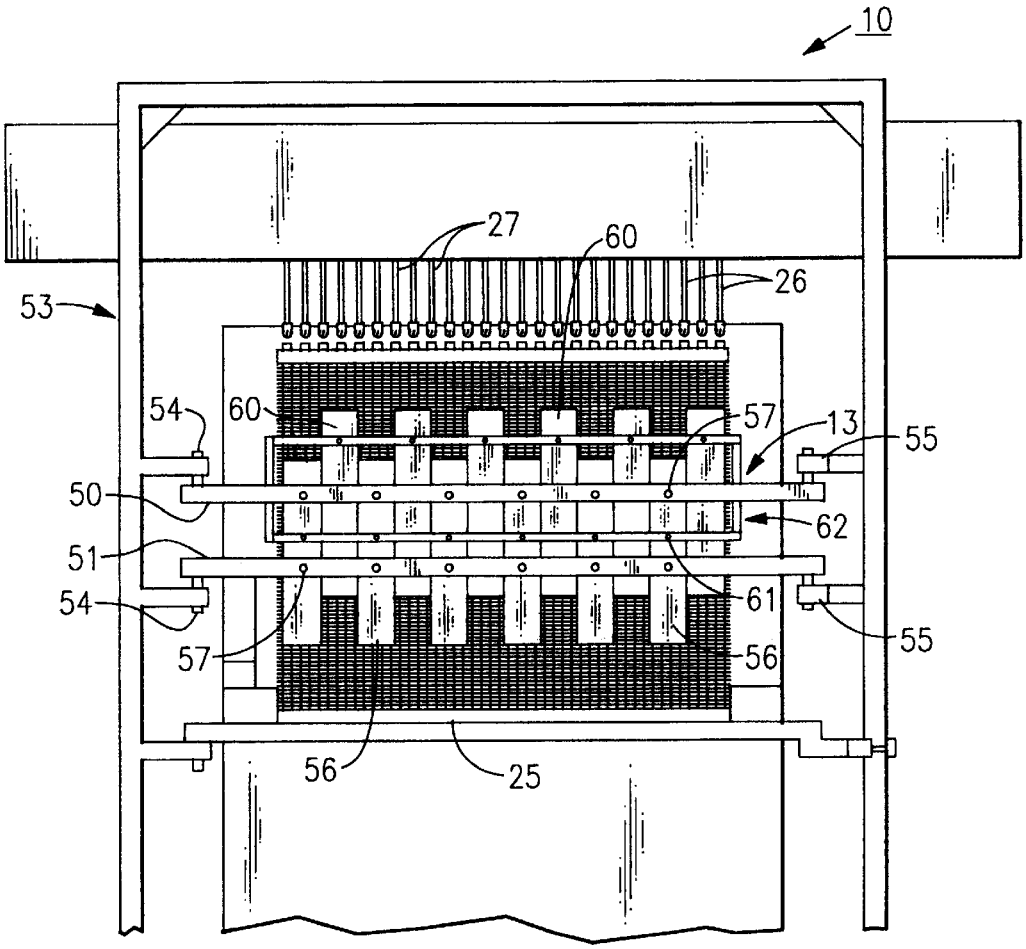
FIG. 3 is a front perspective view of the present apparatus showing the front door of the fixture.

Turning now to FIG. 3, there is illustrated a partial front view of the fixture further illustrating the door 13 of the fixture which can be opened to allow coils to be loaded into and unloaded from the fixture. The door includes a pair of horizontal cross members 50 and 51 that are supported in the main frame 53 of the fixture upon hinges 54. The opposite ends of the two cross members contain a latch 55 that enables the door to be secured in a closed position in the main frame 53. As in the case of the back wall of the fixture, a series of vertically disposed slats 56 are secured to the cross members in a spaced apart relationship by screws 57.

A series of spaced apart vertically aligned moveable slats 60 are secured by screws 61 within a frame 62 so that the moveable slats are aligned within the spaces provided by the stationary slats 56. The frame 62 contains a pair of parallel cross members 64 and 65 that straddle the cross member 50 of the door in assembly and thus hold the moveable frame in the door. When the door is closed and secured, a slight clearance is provided between the back wall and the coil and the door and the coil. The clearance, however, is sufficient to allow the coil to be fully supported as the expander rods move through the coil tubes. As shown in the drawings, the slats do not have to encompass the entire coil to provide the needed support, but should cover minimally the entire mid-region of the coil assembly. As should now be evident, the height of the door, as well as that of the back wall, may be adjusted to provide the needed support for a variety of different size coils during the tube expansion process with a minimum of down time.

While this invention has been explained with reference to the structure disclosed herein, it is not confined to the details set forth and this invention is intended to cover any modifications and changes as may come within the scope of the following claims:

What is claimed is:

1. Apparatus for expanding hairpin tubes of a heat exchanger coil into locking engagement with a pair of spaced apart tube sheets and a stack of fin mounted between the tube sheets, said apparatus including a saddle for supporting the bends of the hairpin tubes so that the tubes are vertically disposed within a fixture with the open ends of the tubes being aligned adjacent to a plurality of tube expanders, a door mounted in a front wall of the fixture, said door closing adjacent a front surface of a coil mounted in the fixture, a back wall located opposite said door in said fixture, said back wall having a series of spaced apart vertically aligned stationary slats, and a frame for slidably supporting a plurality of spaced apart vertically aligned moveable slats interspaced between said stationary slats so that said slats coact to provide a flat back surface adjacent a rear surface of said coil whereby the height of the back wall can be adjusted to accommodate various size coils.

2. The apparatus of claim 1 further includes a stationary upper cross member and a stationary lower cross member to which the stationary slats are secured and said moveable frame further includes a moveable upper cross member and a moveable lower cross member to which the moveable slats are attached.

3. The apparatus of claim 2 wherein the upper stationary cross member is mounted between the two moveable cross members in assembly whereby the moveable slats are retained in the spaces between the stationary slats.

4. The apparatus of claim 1 wherein a close sliding fit is provided between the stationary slats on the moveable slats.

5. The apparatus of claim 1 wherein said door is hingedly secured to said fixture, and further includes a series of vertically disposed, spaced apart stationary slats therein and a series of vertically disposed spaced apart moveable slats slidably mounted in the spaces between the stationary slats whereby the vertical height of the door can also be adjusted.

6. The apparatus of claim 5 that further includes a second moveable frame in said door for adjustably supporting the moveable door slats in assembly.

7. The apparatus of claim 6 wherein said door further includes upper and lower stationary cross pieces to which the stationary slats are secured and said second moveable frame contains upper and lower moveable cross pieces to which the moveable door slats as secured, said upper stationary cross piece being mounted between the moveable upper and lower cross pieces.

* * * * *